US005472329A

United States Patent [19]

Maynard et al.

[11] Patent Number: 5,472,329

[45] Date of Patent: Dec. 5, 1995

[54] GEROTOR PUMP WITH CERAMIC RING

[75] Inventors: Frederick C. Maynard, Cave Creek; Eric D. Moon, Goodyear; Robert E. Wahl, Phoenix, all of Ariz.

[73] Assignee: AlliedSignal Inc., Morris Township, N.J.

[21] Appl. No.: 272,433

[22] Filed: Jul. 8, 1994

Related U.S. Application Data

[63] Continuation of Ser. No. 92,187, Jul. 15, 1993, abandoned.

[51] Int. Cl.[6] ..... F01C 21/10

[52] U.S. Cl. ..... 418/152; 418/166

[58] Field of Search ..... 418/152, 166, 418/179

[56] References Cited

U.S. PATENT DOCUMENTS

| | | | |
|---|---|---|---|
| 2,965,039 | 12/1960 | Morita | 418/166 |
| 3,307,453 | 3/1967 | Nilsson et al. . | |
| 3,881,849 | 5/1975 | Commarmot et al. | 418/182 |
| 3,885,898 | 5/1975 | Lamm et al. | 418/122 |
| 4,059,370 | 11/1977 | Gibson | 418/56 |
| 4,231,727 | 11/1980 | Buchholz et al. | 418/76 |
| 4,384,828 | 5/1983 | Rembold et al. | 418/75 |
| 4,492,540 | 1/1985 | Yamamoto | 418/23 |
| 4,549,862 | 10/1985 | Stich et al. | 418/133 |
| 5,156,540 | 10/1992 | Fernau et al. | 418/152 |

FOREIGN PATENT DOCUMENTS

| | | | |
|---|---|---|---|
| 0066688 | 5/1980 | Japan | 418/152 |
| 0153923 | 9/1984 | Japan | 418/152 |

OTHER PUBLICATIONS

Article from the Sep. 17, 1987 issue (p. 38) of "Machine Design" entitled Gear Pumps.

*Primary Examiner*—Richard A. Bertsch
*Assistant Examiner*—Charles G. Freay
*Attorney, Agent, or Firm*—Jerry J. Holden; James W. McFarland

[57] ABSTRACT

A gerotor pump having reduced drag torque at low temperatures is disclosed. The pump includes a shaft journalled in the housing. Mounted on the shaft are a pair of axially space metallic port plates and disposed therebetween are metallic interior and exterior gears. A ceramic eccentric ring circumscribes the exterior gear to define a diametral clearance.

7 Claims, 3 Drawing Sheets

GEROTOR PUMP WITH CERAMIC RING

This application is a continuation of application Ser. No. 08/092,187, filed Jul. 15, 1993, now abandoned.

TECHNICAL FIELD

The present invention relates to gear pumps, and in particular, to a gerotor pump having a ceramic ring circumscribing a metallic gear.

BACKGROUND OF THE INVENTION

A gerotor pump is a well known type of internal gear pump having a stationary, eccentric ring circumscribing an outer, internal-tooth type gear, which in turn circumscribes an inner, external-tooth type gear mounted on a rotating shaft. The ring and gears are bounded axially by stationary port plates through which the fluid enters and exits. In operation, the meshing of the two gears provides the pumping action. Typically, the ring is made of aluminum and the gears from steel.

Within the aerospace art, as well as other art fields, it is necessary to operate such pumps at low temperatures. For example, aboard aircraft it is sometimes necessary to start and operate the pump inflight where ambient temperatures can get as low as −65° F. When a conventional gerotor pump becomes cold soaked, upon starting it experiences an exceedingly high drag torque. This drag torque remains high until the pump approaches its normal operating temperature, and in extreme cases may prevent the starting or operation of the associated equipment upon which the pump is used.

This undesirable characteristic of conventional gerotor pumps is largely attributable to the conflicting requirements in the design of such pumps. One design requirement is to have sufficiently close operating radial and axial clearances within the pump so that leakage flows are kept to an acceptable minimum during normal operation. Another requirement is that these clearances must be large enough to prevent forceful engagement, (i.e. high drag torque), between the gears and the ring after the gears and ring have undergone thermal contraction during a cold soak.

Thus, there is a need for a gerotor pump that has reduced drag torque at low temperatures in comparison to prior art gerotor pumps.

SUMMARY OF THE INVENTION

An object of the present invention is to provide a gerotor pump having reduced drag torque at low temperatures, and especially after an extended cold soak at temperatures as low as −65° F.

The present invention achieves this object by providing a gerotor pump with a eccentric, ceramic ring circumscribing a metallic gear.

DESCRIPTION OF THE PREFERRED EMBODIMENT

Figure 1:
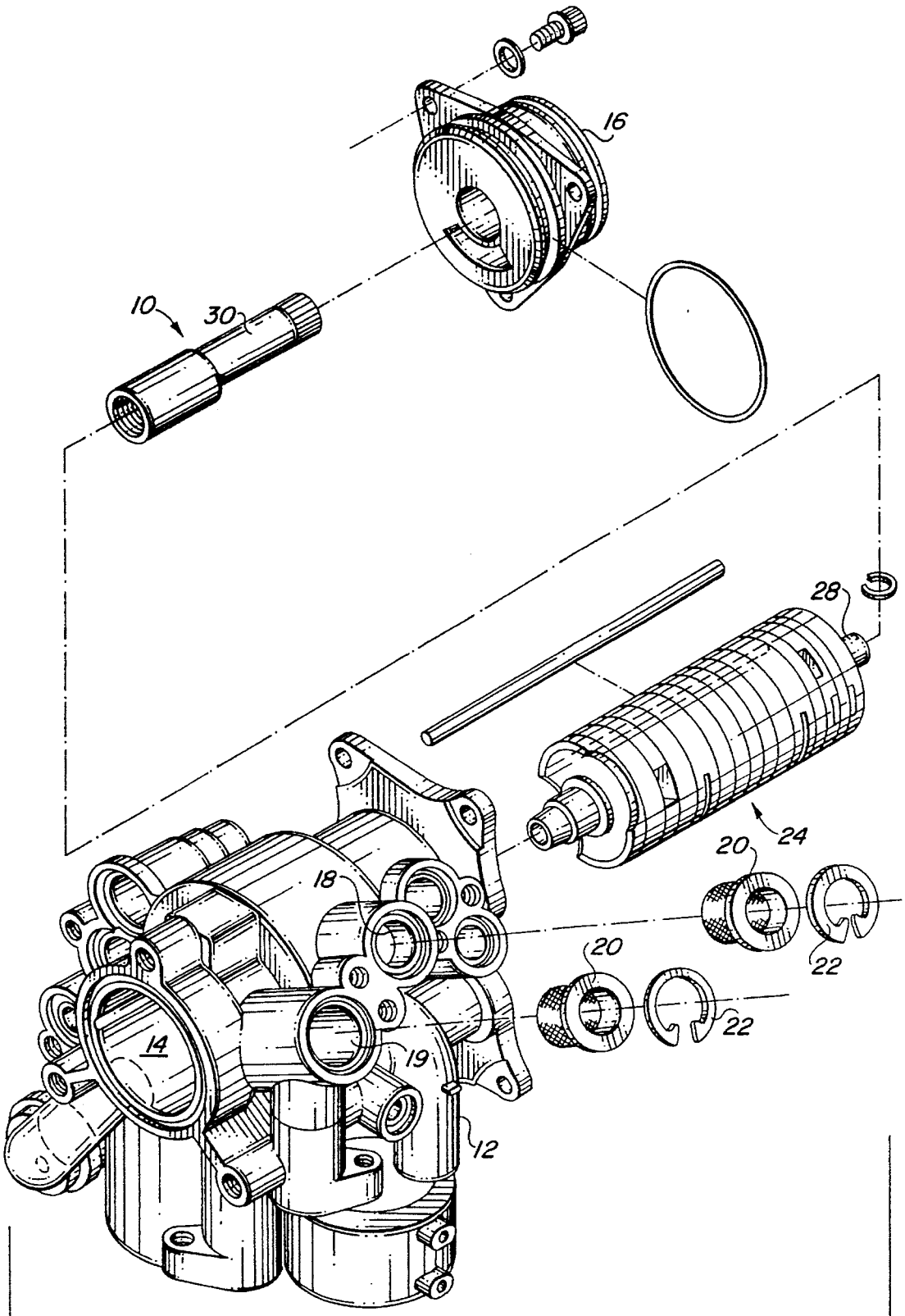
FIG. 1 is an exploded view of the internal gear pump contemplated by the present invention.

FIG. 1 shows an exploded view of a gerotor pump 10. The gerotor pump 10 includes a housing 12 having a cylindrical chamber 14 extending therethrough. The chamber 14 is closed at both ends by a drain cover 16 only one of which is shown. An inlet port 18 and exit port 19 each have a filter 20 held in place by a retainer ring 22. The inlet port 18 receives fluid from a gearbox sump or other source not shown, and delivers the fluid to the chamber 14. Once pressurized the fluid exits the pump 10 through exit port 19.

Mounted within the chamber 14 and between the drain covers 16 is a rotor assembly 24. The rotor assembly is comprised of a plurality of pump stages 26, (see FIG. 2), mounted in parallel arrangement along a shaft 28. The shaft 28 is coupled to a driver, not shown, via a quill shaft 30 that extends through the drain cover 16.

Figure 2:
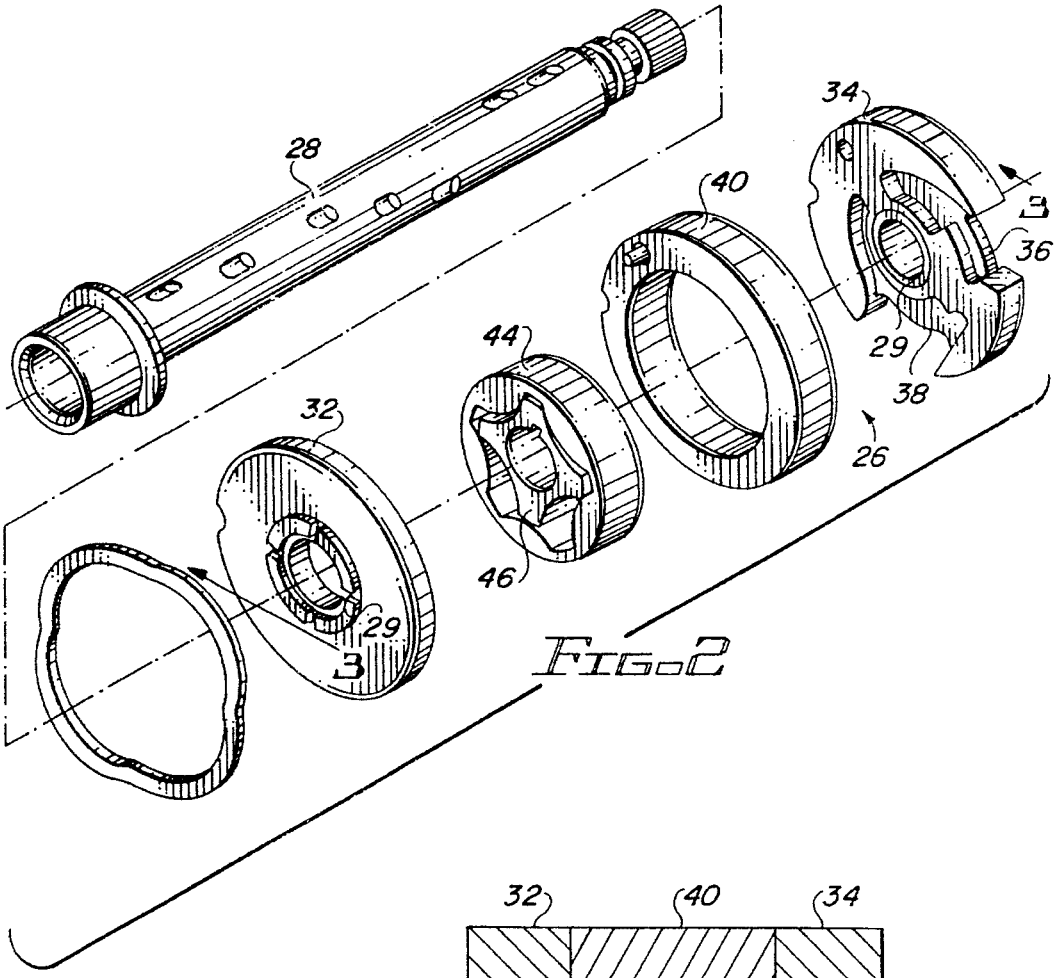
FIG. 2 is an exploded view of a portion of the shaft assembly of the pump in FIG. 1.
Figure 3:
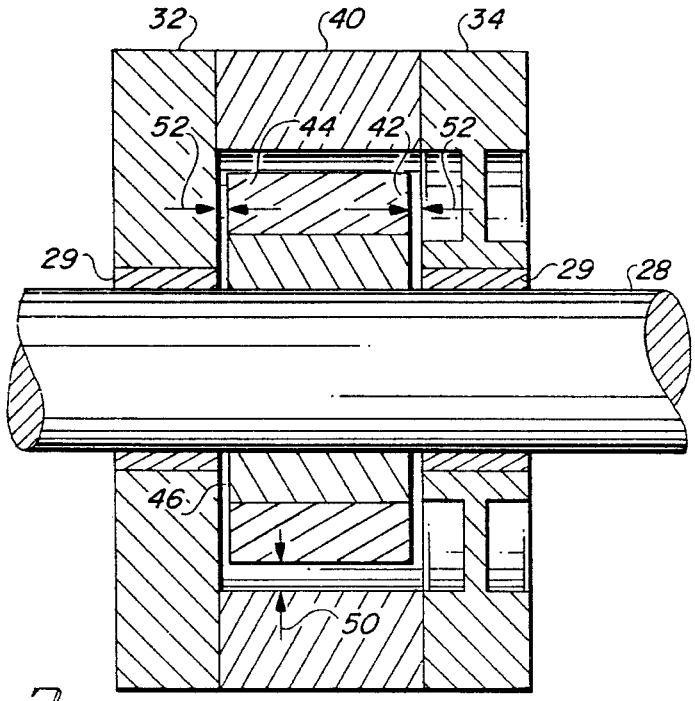
FIG. 3 is a cross sectional view taken along line 3—3 of FIG. 2.

Each of the pump stages 26, one of which is shown in FIG. 2, is comprised of two, stationary port plates 32, 34 axially spaced apart and mounted on bearings 29 which are mounted to the shaft 28. The port plate 34 has an inlet channel 36 for receiving the fluid from the inlet port 18 and an exit channel 38 for delivering pressurized fluid to the exit port 19. Though not necessary, the port plate 32 may also have channels equivalent to channels 36, 38. Disposed between the port plates 32, 34 and mounted thereto is a eccentric ring 40. The combination of eccentric ring 40, plates 32, 34 and the shaft 28 defines an eccentric, annular chamber 42. Disposed in the chamber 42 is an outer, internal-tooth type gear 44 circumscribing and in meshing engagement with an inner, external-tooth type gear 46 mounted for rotation on the shaft 28. The gears 44, 46 are disposed in the chamber 42 so as to define a diametral clearance 50 between the outer gear 44 and the ring 40 and an axial clearance 52 between the gears 44, 46 and the port plates 32, 34.

In the preferred embodiment, the plate ports 32, 34 are made of aluminum and the gears 44, 46 are made of steel. Importantly, the ring 40 is made from the ceramic silicon nitride having a thermal coefficient of expansion of about $3.4\times10^{-6}$/C., a fracture toughness of about 8.1 $MPa*m^{1/2}$, and a thermal conductivity of about 35 W/(m*K). The thermal conductivity is on par with most steels, (15–50 W/(m*K), and allows significant heat removal during the normal operation of the pump.

Alternatively, the ring 40 is made of silicon carbide which has properties generally equivalent to silicon nitride except that the fracture toughness is lower, (2–4 $MPa*m^{1/2}$).

Figure 4:
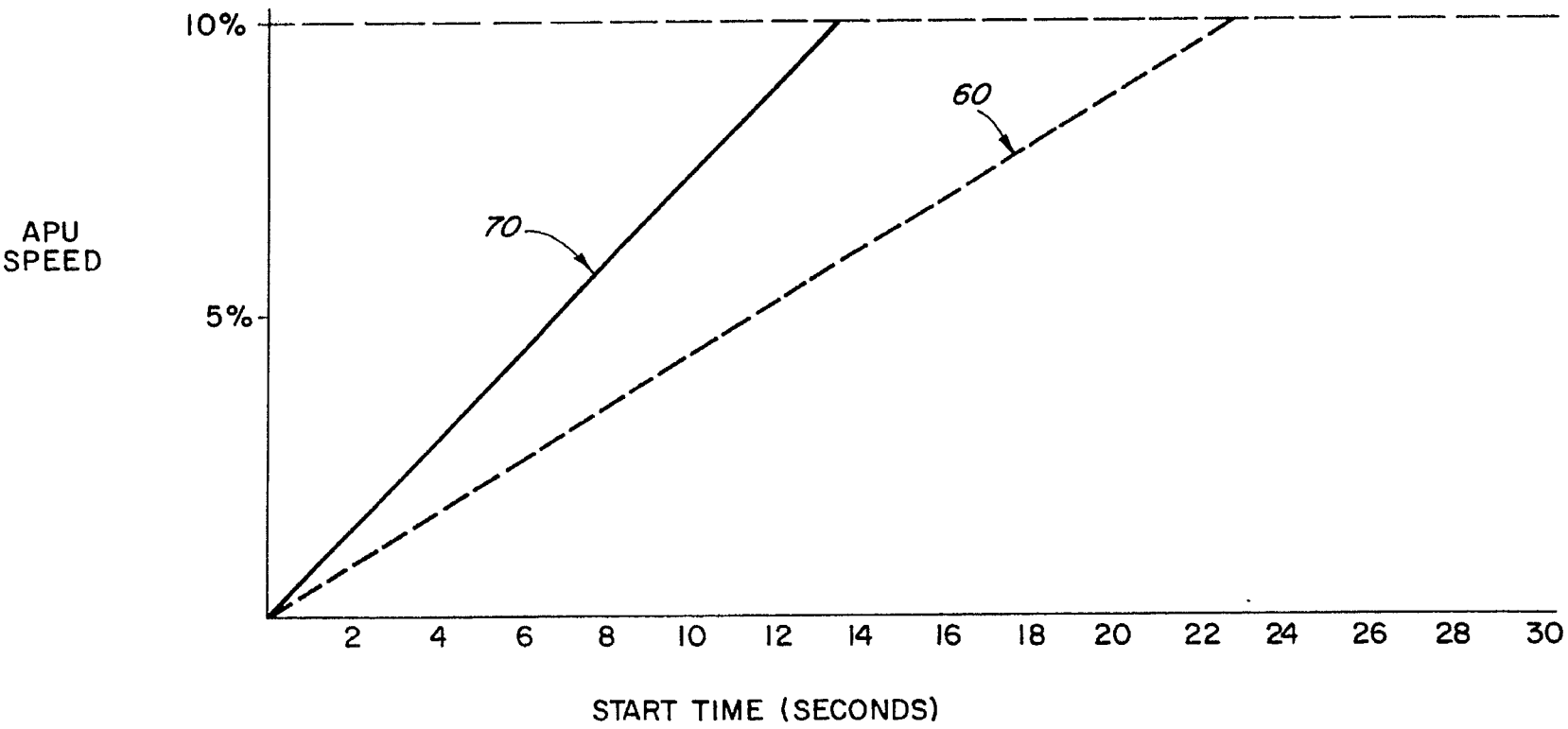
FIG. 4 is a graph of engine speed vs. start time.

The reduced drag torque of the subject invention in comparison to the closest prior art has been demonstrated through testing. The results of this testing are shown in FIG. 4. The testing was conducted on a Garrett 331–350 Auxiliary Power Unit (APU) in an altitude tank simulating a two hour soak at 40,000 feet, (−69.7° F.). First, a conventional gerotor lube pump of the type normally used on the 331–350 APU was mounted to the test engine. This prior art lube pump contained aluminum rings with a thermal coefficient of expansion in the range of $20–24\times10^{-6}$/C. and steel gears with a thermal coefficient of expansion in the range of $10–12\times10^{-6}$/C. A non-deoiled and non-deprimed start of the APU was made and the APU took approximately 22 seconds to reach 10 percent of its operating speed. (see line 60 in FIG. 4). The prior art lube pump was replaced with an identical pump having silicon nitride rings in accordance with the subject invention. This pump 10 was then mounted to the engine and the test was repeated. As shown by line 70 in FIG. 4, with the lube pump 10, the APU was able to achieve 10 percent of operating speed in about 14 seconds. These tests revealed a surprising 47% improvement in initial engine acceleration under equivalent cold soak conditions. This improvement is attributed to increased diametral and side clearances resulting from the ceramic ring's resistance to thermal contraction when exposed to decreasing temperatures. The increased clearances reduces the viscous shearing force of the cold oil, lowering the required input torque to the pump.

Thus, a gerotor pump is provided that demonstrates reduced drag torque at low temperatures in comparison with prior art gerotor pumps.

Various modifications and alterations to the above described preferred embodiment will be apparent to those skilled in the art. Accordingly, this description of the invention should be considered exemplary and not as limiting the scope and spirit of the invention as set forth in the following claims.

What is claimed is:

1. A gerotor pump for coupling to an auxiliary power unit mounted in an aircraft comprising:

a housing having an inlet and exit port in fluid communication with a chamber therein;

a shaft journalled in the housing and extending through said chamber;

a first metallic port plate supported by a first bearing mounted on said shaft;

a second metallic port plate supported by a second bearing mounted on said shaft and axially spaced from said first port plate;

a first metallic gear having external teeth and mounted for rotation to said shaft;

a second metallic gear having internal teeth in meshing engagement with said external teeth, said first and second gears disposed between and axially spaced from said first and second port plates to define an axial clearance; and a ceramic eccentric ring circumscribing said second gear to define a diametral clearance, and mounted between said port plates so that under cold soak conditions said diametral and axial clearances are sufficiently large so that the time it takes said auxiliary power unit to reach ten percent of its operating speed is shorter in comparison with said auxiliary power unit having a gerotor pump with a metallic eccentric ring.

2. The gerotor of claim 1 wherein said ceramic is silicon nitride.

3. The gerotor of claim 2 wherein said metal is steel.

4. The gerotor of claim 2 wherein said silicon nitride has a thermal conductivity in the range of 15–50 W/(m*K).

5. The gerotor of claim 4 wherein said silicon nitride has a fracture toughness of about 8.1 $MPa*m^{1/2}$.

6. The gerotor of claim 5 wherein said silicon nitride has a thermal coefficient of expansion of about $3.4\times10^{-6}$ C.

7. The gerotor pump of claim 1 wherein said time is at least 47% shorter.

* * * * *